United States Patent [19]

Carbone et al.

[11] 3,956,073

[45] May 11, 1976

[54] COKE OVEN GAS AND LIQUOR COLLECTING APPARATUS

[75] Inventors: Walter E. Carbone, Summit; Paul V. Faber, Morristown, both of N.J.

[73] Assignee: Wilputte Corporation, Murray Hill, N.J.

[22] Filed: Feb. 18, 1975

[21] Appl. No.: 550,266

Related U.S. Application Data

[63] Continuation-in-part of Ser. No. 392,873, Aug. 30, 1973, abandoned.

[52] U.S. Cl. ..... 202/254; 201/40; 202/263; 137/599; 137/625.46

[51] Int. Cl.[2] ..... C10B 27/06

[58] Field of Search ..... 201/40; 202/263, 260, 202/259, 258, 257, 256, 255, 254; 137/599, 625.46

[56] References Cited

UNITED STATES PATENTS

| | | | |
|---|---|---|---|
| 2,218,916 | 10/1940 | Koppers | 202/255 |
| 2,266,949 | 12/1941 | Becker | 202/256 |
| 2,975,109 | 3/1961 | Van Ackeren | 202/255 X |
| 3,697,381 | 10/1972 | Kemmetmueller | 202/263 X |
| 3,764,482 | 10/1973 | Yoshida et al. | 202/263 X |
| 3,804,721 | 4/1974 | Gidick | 202/256 |

FOREIGN PATENTS OR APPLICATIONS

| | | | |
|---|---|---|---|
| 170,987 | 11/1921 | United Kingdom | 202/258 |
| 273,038 | 4/1914 | Germany | 202/258 |

*Primary Examiner*—James M. Tayman, Jr.
*Attorney, Agent, or Firm*—Buell, Blenko, And Ziesenheim

[57] ABSTRACT

Coke oven gas collecting apparatus includes separate gas and liquor collecting mains for charging gas and coking gas connected to the standpipe through a rotary vane liquor seal valve.

4 Claims, 3 Drawing Figures

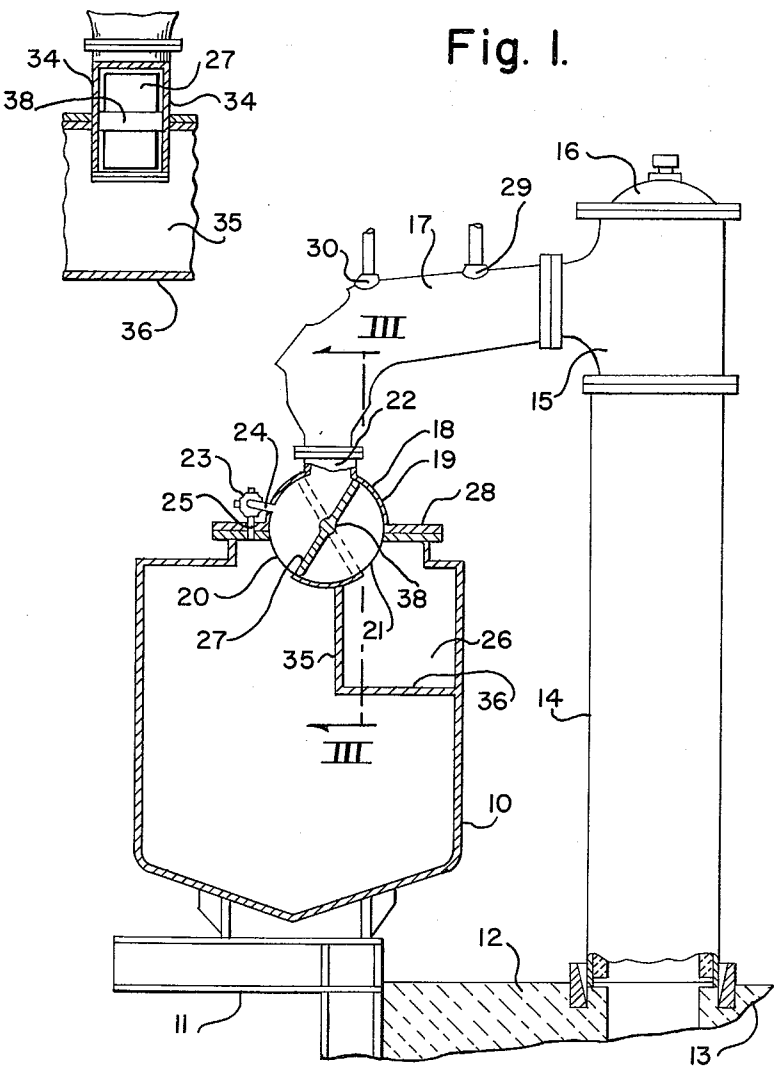
Fig. 1.
Fig. 3.
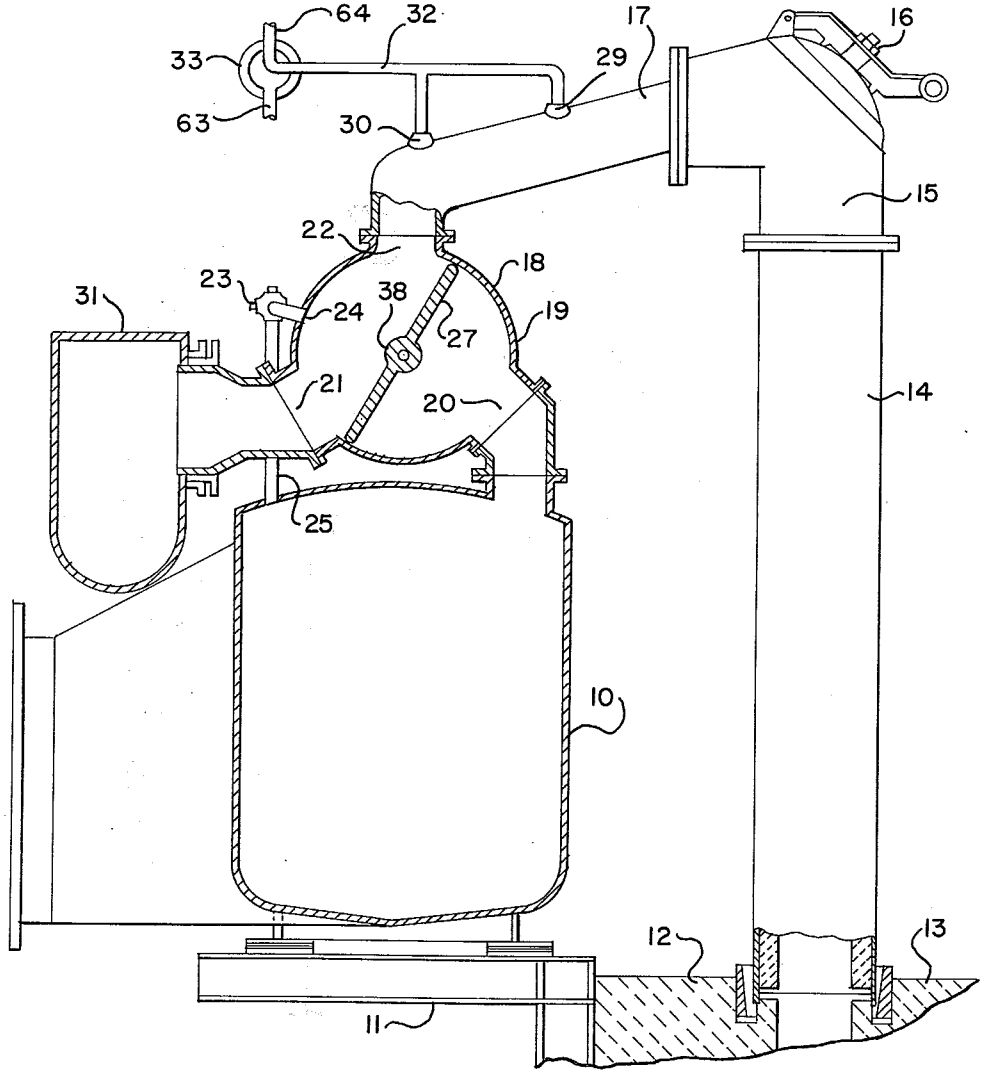
Fig. 2.

COKE OVEN GAS AND LIQUOR COLLECTING APPARATUS

This application is a continuation-in-part of our application Ser. No. 392,873, filed Aug. 30, 1973, and now abandoned.

This invention relates to apparatus for collecting gases from coke ovens. It is more particularly concerned with apparatus for collecting separately the gases evolved during the charging of coal and the gases evolved during the coking thereof.

Modern by-product coke oven batteries are conventionally constructed in the form of a large number of relatively narrow ovens positioned side-by-side. The coke oven gas evolved during the coking operation is collected from the top of each oven by a standpipe, or ascension pipe, as it is sometimes called, which projects vertically above the top of the oven and connects through an elbow with a coke oven gas main which runs along the battery. Some types of batteries have a single standpipe for each coke oven located at one end and a single coke oven gas collecting main. Others have a standpipe at each end of each oven and a gas collecting main running along each side of the battery.

Into the downcomer connecting the standpipe elbow with the gas collecting main is sprayed a liquid known as flushing liquor, and it is also conventional to spray flushing liquor into the gas collecting main. This liquor is sprayed in amounts sufficient to cool the coke oven gas and cause precipitation of tars therefrom. It is an aqueous weakly ammoniacal liquor which is the condensate from the volatile products given off in the coking process. Flushing liquor is circulated through apparatus to recover ammonia and to separate tars therefrom and back to the sprays, so that its composition at any given point in the system is essentially constant.

The end of the downcomer communicating with the collecting main is closed by a valve comprising a pan hinged to the discharge end of the downcomer at one side. When the valve is closed, the edges of the pan extend upwardly outside the discharge end of the downcomer and the pan fills with flushing liquor, which overflows its edges into the collecting main, thus sealing off the downcomer from the collecting main. Valves of this type are known as liquor seal valves.

Each oven has several charging holes with covers in its roof through which raw coal is introduced. When the coal makes contact with the hot oven refractories quantities of volatile constituents and entrained solids are suddenly evolved. These gases and solids are largely carried over into the gas collecting main, although some escape into the atmosphere. The presence of coal dust above a relatively low level in the gas going to the by-product plant is quite undesirable as those solids clog the spray outlets for recirculated liquor in the by-product system and degrade the recovered coal tar by raising its ash and moisture contents. It has been standard practice to wet the coal before charging to reduce the carryover of coal dust into the gas collecting main and to reduce the quantity of gases and solids emitted into the atmosphere. It is not possible, however, by these means to eliminate discharge of those constituents.

Environmental considerations now require that the discharge of those gases and solids into the atmosphere be prevented, and various closed charging systems have been devised to this end. One such system is pipeline charging in which the coal is fluidized and transported through a pipe into the oven by a carrier gas. This operation, however, requires dry coal and in practice the coal is usually preheated to a temperature of about 500°F. Thus, the quantity of coal dust and other suspended solids resulting from pipeline charging is considerably greater than that from conventional wet coal charging, and, although some of the carrier gas is usually bled off before it enters the oven, the volume of gases to be accommodated is substantially increased. These factors combine to raise the solids content of the gas evolved during charging well above a level that can be accepted by the coke oven gas.

Proposals have been made to collect the gases evolved during charging in a collecting main separate from the conventional collecting main for the gases evolved during coking. Apparatus designed for that purpose is disclosed in U.S. Pat. No. 2,218,916 granted to A. Koppers on Oct. 22, 1940 and in U.S. Pat. No. 2,975,109 granted to P. Van Ackeren on Mar. 14, 1961. In each of those patents the charging gas is collected at the end of the oven opposite that at which the coking gas is collected and the charging gas collecting main and coking gas collecting main are disposed along opposite sides of the coke oven battery. Separate charging gas and coking gas mains on the same side of the battery are disclosed in British Pat. No. 170,987, granted to P. Thiele on or shortly after Nov. 10, 1921. The latter patent also discloses a single standpipe provided with a valve for directing gases from the oven into the charging gas collecting main or into the coking gas collecting main. That valve, however, is not a liquor seal valve.

U.S. Pat. No. 3,804,721, granted to W. T. Gidick on Apr. 16, 1974 discloses apparatus including a collecting main divided by an upwardly extending partition and a liquor seal valve which in one position directs gases and liquor from a standpipe to one side of the partition and in another position directs gases and liquor to the other side of the partition. In Gidick's apparatus the partition does not seal the two portions of the divided collecting main from each other, and raw charging gas can find its way into the coking gas collecting portion of the main.

It is an object of our invention to provide byproduct coking battery apparatus which through a liquor seal valve collects coking gas and flushing liquor separately from charging gas and any liquor introduced into it, either in separate collecting mains or in a divided collecting main in which the two portions are sealed off from each other.

It is another object to provide such apparatus using a rotary vane type valve. Other objects of our invention will become apparent in the course of the description thereof which follows.

We accomplish the objects above mentioned by connecting the discharge end of the downcomer to separate collecting mains for coking gas and for charging gas through a novel rotary vane liquor seal valve to be described. The separate collecting mains may be physically separate structures or a single main partitioned into two sections. The separate gas collecting mains also serve as collecting mains for flushing liquor sprayed into the coking gas in the standpipe and charging liquor sprayed into the charging gas in the standpipe.

Two embodiments of our invention presently preferred by us are illustrated in the attached FIGS., to which reference is now made:

FIG. 1 is a diagramatic elevation of an embodiment of our invention in which coking gases and charging gases are collected in separately partitioned-off portions of a collecting main through a rotary vane liquor seal valve integral therewith.

FIG. 2 is a diagramatic elevation of an embodiment of our invention in which coking gases and charging gases are collected in physically separate collecting mains through a discrete rotary vane liquor seal valve.

FIG. 3 is a cross section of the apparatus of FIG. 1 taken on the plane III—III.

In FIG. 1 a gas collecting main 10 is supported on a structure 11 along one side of a coke oven battery adjacent the ends of the ovens constituting that battery. From roof 12 of coke oven 13 rises a vertical standpipe 14. Its upper end is connected to an elbow 15 having a removable cover 16 thereon. The elbow 15 in turn is connected to downcomer 17 which at its lower end opens into an inlet port 22 in the upper surface of a rotary vane valve 18. The valve 18 comprises a cylindrical casing 19 which is set with its axis horizontal into cover plate 28 of collecting main 10 so that the upper half of casing 19 projects above that cover plate and the lower half is within collecting main 10. In casing 19 is mounted a rotary vane 27 which extends diameterally thereacross. Vane 27 is affixed to a shaft 38 which is journaled on the axis of casing 19 in sides 34 thereof and extends through those sides. In the lower half of casing 19 are two outlet ports 20 and 21. Outlet ports 20 and 21 and inlet port 22 are spaced equidistantly around the circumference of casing 19. Outlet port 20 discharges into the major portion of collecting main 10. Outlet port 21 discharges into a minor portion of collecting main 10 which is partitioned off by vertical wall 35 and horizontal wall 36 to form a smaller separate collecting main 26 within collecting main 10 against one side wall and cover plate 28 thereof. Wall 36 projects inwardly from one side wall of collecting main 10 and wall 35 projects upwardly from wall 36 to the portion of casing 19 between discharge ports 20 and 21, and further upwardly along and affixed to sides 34 of casing 19, ending at cover plate 28.

Vane 27 can be moved to any one of three positions by means, not shown, attached to shaft 38. In FIG. 1 it is illustrated in the position in which it connects inlet port 22 with outlet port 20 and closes off outlet port 21. Rotated 60° counterclockwise from its illustrated position it connects inlet port 22 with outlet port 21 and closes off outlet port 20. Rotated another 60° further counterclockwise it closes off outlet ports 20 and 21 from inlet port 22 except for a liquor seal pipe 23. The upper end 24 of liquor seal pipe 23 opens into casing 19 at a location between the inlet port 22 and the horizontal position of vane 27 and the lower end 25 opens into collecting main 10. A spray nozzle 29 is positioned in the upper wall of downcomer 17 and is connected to a source of charging liquor, not shown. Another spray nozzle 30 is positioned in upper wall of downcomer 17 downstream of nozzle 29 and is connected with a source of flushing liquor, not shown.

In the coking operation the apparatus above described is adjusted as shown in FIG. 1. Vane 27 connects inlet port 22 of valve 18 with outlet port 20 which leads to gas collecting main 10. Gas from the oven 13 thus passes into collecting main 10. Flushing liquor is supplied to spray nozzle 30. When the oven is to be charged with fresh coal, however, vane 27 is moved counterclockwise until it connects inlet port 22 with outlet port 21. This latter port leads into collecting main 26 as has been mentioned. The gas from the oven is thus directed into that main. Simultaneously charging liquor is supplied to spray nozzle 29 and flushing liquor is cut off from spray nozzle 30. The charging liquor falls into collecting main 26 from which it is drained at a point not shown. The charging liquor is essentially water plus some ammonia absorbed from the charge and carrying coal dust in suspension. In this way, the gas evolved during charging is not mixed at the oven with the coke oven gas nor is it allowed to escape into the atmosphere. After it is cleaned of its coal dust, it is returned to the stream of gas going to the by-product plant.

The charging liquor, together with suspended solids, is directed into apparatus, not shown, for separating the coal dust and other solids therefrom. After this operation the charging liquor is recycled, still separately from the flushing liquor. It is not desirable to contaminate flushing liquor with charging liquor. The charging cycle requires only a few minutes time in any individual oven and the charging liquor is sprayed into the gases evolved during charging only for this relatively short period of time, whereas the coking cycle for each oven is measured in hours and the flushing liquor is sprayed into the gas evolved during coking throughout that time. The equilibrium compositions of the two liquors, which initially are merely water, are thus quite different.

When it is desired to seal off the oven altogether from both mains, for decarbonizing, vane 27 is moved to its horizontal position. However, flushing liquor overflows into gas collecting main 10 through liquor seal pipe 23, so maintaining the liquor seal in the valve.

The apparatus of FIG. 2 is essentially the same as that of FIG. 1 and like elements in those two embodiments carry like reference characters. In incorporating our invention into existing coke oven batteries it may not be economical to rebuild the gas collecting mains so as to contain valves 18 and internal charging gas collecting main 26 as they are shown in FIG. 1. In the apparatus of FIG. 2 valve 18 is mounted above coking gas collecting main 10 and a physically separate external charging gas collecting main 31 is provided. As before, standpipe 14 on oven 13 is connected through elbow 15 and downcomer 17 to the inlet port 22 of a rotary vane type valve 19. Discharge port 20 leads from valve 19 into coke oven gas collecting main 10. Discharge port 21 leads into charging gas collecting main 31 which is positioned alongside main 10 and partially above it. It will be observed that in FIG. 2 charging gas collecting main 31 is on the opposite side of gas collecting main 10 from FIG. 1 and that discharge ports 20 and 21 of valve 19 are interchanged in position from that shown in FIG. 1. This is merely because in most conventional batteries there would not be sufficient room between coke oven gas collecting main 10 and standpipe 14 to receive external charging gas collecting main 31. The operation of our apparatus is not affected by this change. It will also be observed that spray nozzles 29 and 30 in downcomer 17 are connected through the same pipe 32 to a three-way valve 33. One inlet 63 of this valve is connected to a source of flushing liquor, not shown. The other inlet 64 is connected to a source of charging liquor, also not shown. This arrangement permits the use of the same spray nozzles for either type of liquor.

The operation of the apparatus of FIG. 2 is no different from that of the apparatus of FIG. 1 which has been described. Vane 27 of valve 19 is shown in charging position in FIG. 2. During that operation valve 33 is turned to the position in which it admits charging liquor from inlet 64 to spray nozzles 29 and 30. The gases evolved during the charging of oven 13 rise through standpipe 14 and pass through elbow 15 and downcomer 17 into valve 19. Those gases, together with charging liquor sprayed into them, pass through discharge port 21 of valve 19 into charging gas collecting main 31.

In the foregoing specification we have described presently preferred embodiments of our invention; however, it will be understood that this invention can be otherwise embodied within the scope of the following claims.

We claim:

1. In a by-product coke oven battery comprising a plurality of coke ovens, a standpipe opening out of the top of each oven, a coking gas collecting main and a charging gas collecting main, the improvement comprising a cylindrical valve body disposed with its axis horizontal, an inlet port in the upper circumferential surface of the valve body positioned above a diameter thereof, connected to the standpipe, two outlet ports separated from each other in the lower circumferential surface of the valve body, below the aforesaid diameter thereof, one connected to the coking gas collecting main and the other to the charging gas collecting main, a vane within the valve body adapted to rotate about the valve body axis from a position connecting the inlet port with one outlet port, through an intermediate position closing off the inlet port from both outlet ports, to a position connecting the inlet port with the other outlet port, and an overflow conduit opening out of the valve body above the aforesaid diameter thereof and discharging into one of the collecting mains, positioned to maintain a liquor seal in the valve in its intermediate position.

2. Apparatus of claim 1 in which the charging gas collecting main is a partitioned-off portion of the coking gas collecting main formed by a longitudinally extending partition, the upper edge of which is sealed to the upper surface of the coking gas collecting main between the connections to the coking gas outlet port and the charging gas outlet port of the valve body, and the other edges of which are sealed to the coking gas collecting main surface so as to prevent the intermingling of charging gas with coking gas in the collecting mains.

3. Apparatus of claim 1 including means for introducing flushing liquor and charging liquor separate from each other into the standpipe, means for collecting flushing liquor from the coking gas collecting main, and means for collecting charging liquor from the charging gas collecting main.

4. Apparatus of claim 2 in which a lower portion of the valve body including the outlet ports is set into the upper surface of the coking gas collecting main and the upper edge of the partition is sealed to that lower portion of the valve body.

* * * * *